US008113997B2

(12) United States Patent
Fernandez et al.

(10) Patent No.: US 8,113,997 B2
(45) Date of Patent: Feb. 14, 2012

(54) AB WAVE ABDOMINAL EXERCISER

(75) Inventors: Juan Fernandez, Towaco, NJ (US); Robert Kennedy, Ottawa (CA); Paul McGrath, Towaco, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 0 days.

(21) Appl. No.: 12/584,877

(22) Filed: Sep. 14, 2009

(65) Prior Publication Data

US 2010/0099542 A1 Apr. 22, 2010

Related U.S. Application Data

(60) Provisional application No. 61/097,257, filed on Sep. 16, 2008.

(51) Int. Cl.
*A63B 21/00* (2006.01)

(52) U.S. Cl. ..... 482/71; 482/70; 482/51

(58) Field of Classification Search ..... 482/95, 482/130, 141, 142, 96, 72, 51, 111, 70
See application file for complete search history.

(56) References Cited

U.S. PATENT DOCUMENTS

| | | | | |
|---|---|---|---|---|
| 1,979,716 | A * | 11/1934 | Terry | 482/72 |
| 5,470,295 | A * | 11/1995 | Wang | 482/71 |
| 5,971,894 | A * | 10/1999 | Chen | 482/57 |
| 6,244,995 | B1 * | 6/2001 | Prsala | 482/96 |
| 7,004,894 | B1 | 2/2006 | Trotter | |
| 2005/0164848 | A1 * | 7/2005 | Carbone | 482/92 |
| 2009/0118104 | A1 | 5/2009 | Chou | |

* cited by examiner

*Primary Examiner* — Jerome W Donnelly
(74) *Attorney, Agent, or Firm* — Gearhart Law, LLC

(57) ABSTRACT

The present invention discloses an article of manufacture having at least one curved rail that is supported in an upright position with a supporting mean. The supporting means may be a stand, which may also contain at least one-foot holder and an arm bar. The curved rail or rails contains a seat that is capable of laterally sliding along the curved rail. The seat may swivel and contain handles for additional set of exercises.

9 Claims, 7 Drawing Sheets

AB WAVE ABDOMINAL EXERCISER

CLAIM OF PRIORITY

This application claims the priority of U.S. Ser. No. 61/097,257 filed on Sep. 16, 2008, the contents of which are fully incorporated herein by reference.

FIELD OF THE INVENTION

The invention relates to a musculature-building device for personal and commercial use.

BACKGROUND OF THE INVENTION

The invention relates to a exerciser that is effective in developing and strengthening muscles of a stomach, arms, legs and back. Other muscle groups may also be positively affected indirectly through an association with the muscle groups being benefited directly.

The devices that exist in the art tend to be very bulky, expensive, or too simplistic to be effective. The simplest form of a prior art exerciser may be a bench with a foot brace, with a person sitting on such a bench leaning backward while anchoring feet within a foot brace. Such an exerciser only trains one group of muscles and is therefore not very time efficient.

More mechanized and sophisticated forms of abdominal trainers are available. However, they tend to require many adjustments, attachments and other forms of expensive and difficult to use contraptions that distract from the spirit and purpose of the endeavor. Also the prior art devices generally specialize on strengthening a single muscle group or a close-knit group of muscles. Whereas the present invention is capable of exercising muscles in at least five major areas of the body. Additionally, the prior art devices rely on a range of adaptations that create resistance to the rhythmic motion of an exercise. However, these adaptations tend to be linear and unnatural. On the contrary, the present invention utilizes a curvature of a rail to harness the ever-present force gravity to create an effective, yet simple and compact exerciser.

This exercise product focuses mainly on of the conditioning of the abdominal area. The unit exercises the upper, middle, and lower Abs. Upper body exercises can also be incorporated into the unit. The principle of the unit is the back and forth sliding of the seat along at least one, and preferably a set of curved rails. The general movement of sit-ups is performed with the added feature of a sliding seat. Generally, sit-ups are done while lying down and rotating bending about the hip/stomach area. The present invention provides a similar movement with the added sliding feature, which also incorporates the use of a person's legs.

DESCRIPTION OF THE RELATED ART

U.S. Patent Application Publication No. 2009/0118104 discloses an abdominal muscle exercise machine that generally contains a diagonal member with an adjustable seat and a backrest and a pivot member that pivots with respect to the diagonal member. A chest push can be mechanically coupled to the pivot member through an adjustable force multiplier. An optional counterweight can be placed near one end of the pivot member to lighten the force, or an optional load weight can be placed near the other end of the pivot member to increase the force. The pivot member can be constructed to telescope or otherwise adjust for different body sizes. The machine provides a smooth exercise where the top and bottom portions of the body move together in a linked fashion. The machine of the present invention works without heavy external weights.

U.S. Pat. No. 7,004,894 discloses an abdominal muscle exercise machine having a body support plate having a lower surface, a front end, and a rear end; front and rear slide shafts; first and second tubular quills slidably interconnecting the front and rear slide shafts and the lower surface of the body support plate for alternate forward and rearward sliding motions of the front and rear slide shaft; a front "T" handle; a roller bracket interconnecting the front "T" handle and the front slide shaft for alternate forward and rearward rolling motion of the front "T" handle along the front slide shaft; and a rear "T" handle fixedly attached to the rear slide shaft.

Various implements are known in the art, but fail to address all of the problems solved by the invention described herein. One embodiment of this invention is illustrated in the accompanying drawings and will be described in more detail herein below.

SUMMARY OF THE INVENTION

The present invention discloses an article of manufacture having at least one curved rail that is supported in an upright position with a supporting means. The supporting means may be a stand, which may also contain at least one-foot holder and an arm bar. The curved rail or rails contains a seat that is capable of laterally sliding along the curved rail. The seat may swivel and contain handles for additional set of exercises.

Therefore, the present invention succeeds in conferring the following, and others not mentioned, desirable and useful benefits and objectives.

It is an object of the present invention to provide an effective exerciser.

It is another object of the present invention to provide an exerciser that is easy to use and which is practical and inexpensive to produce and distribute.

Yet another object of the present invention is to provide an exerciser capable of unique sliding movement on curved rails.

Still another object of the present invention is to provide a device capable of having a fixed or swivel seat.

Still another object of the present invention is to provide an exerciser with adjustable length foot holders.

Yet another object of the present invention is to provide an exerciser with adjustable length arm bars or seat handles.

Still another object of the present invention is to provide an exerciser where arm muscles are being trained along with abdominal, back or leg muscles, by using arm bars, which may rock against a resistive force.

Still another object of the present invention is to provide an exerciser being capable of varying the sliding resistance of a seat.

DESCRIPTION OF THE PREFERRED EMBODIMENTS

Figure 1:
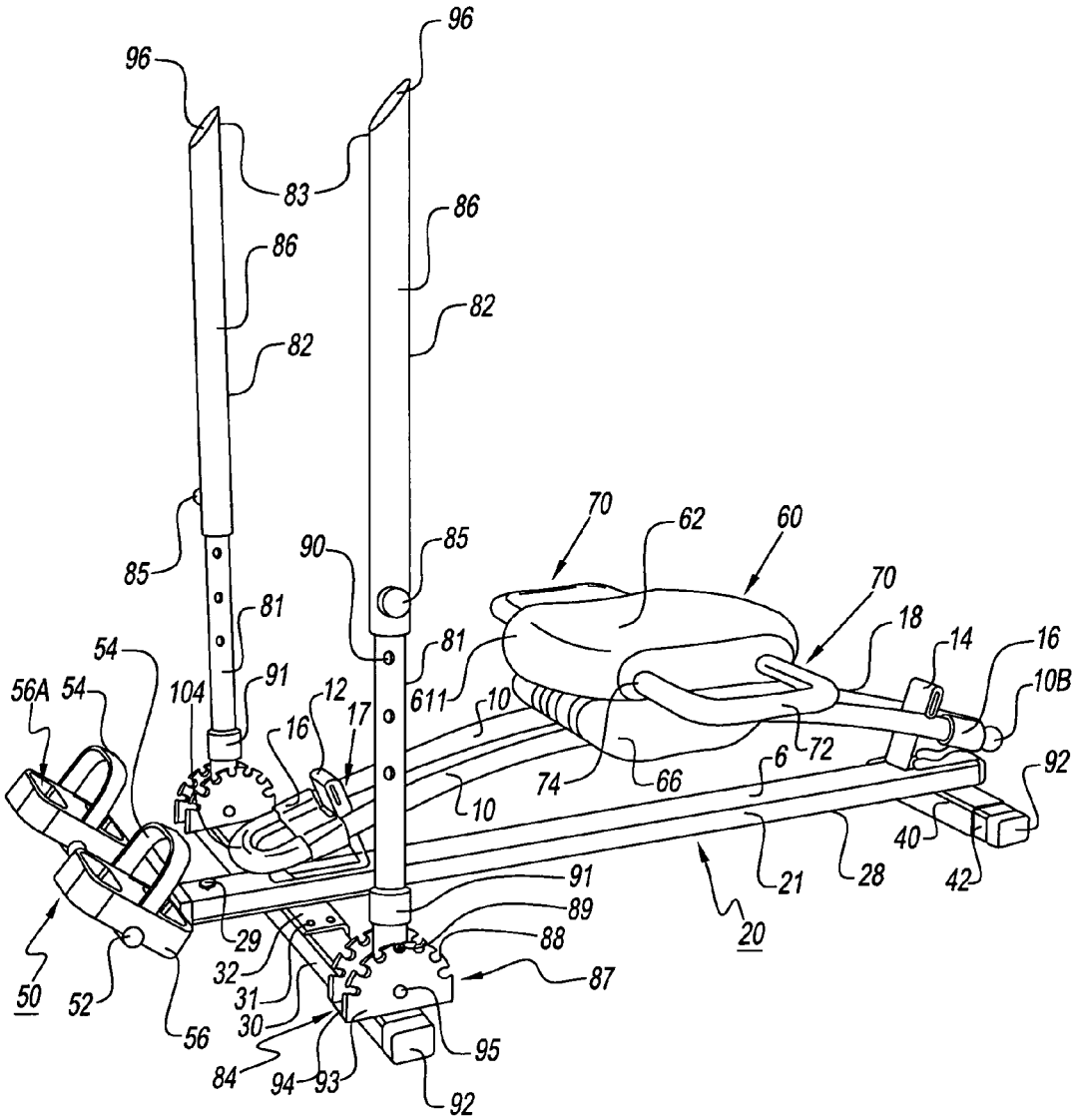
FIG. 1 is a perspective side view of the preferred embodiment of the present invention.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 is a perspective view of the side of the present invention. Shown are an apparatus 5, a rail 10 that is preferably curved, a front bracket 12, a back bracket 14, a buffer 16, a front slope 17, a back slope 18, a peak 19, a stand 20, a longitudinal brace 21, a front end 22, a back end 24, a stand top 26, a stand bottom 28, a set screw 29, a front end rail 30, fasteners 31, a bracket 32, a back end rail 40, sliding elements 42, a front section 50, an extension bar 51, a perpendicular bar 52, a foot holder 53, a strap 54, a mount area 55, a foot platform 56, a bumpy surface 56A, a seat 60, a middle of the seat 62, edges of the seat 64, a slider 66, a handle 70, a grip area 72, a mount area 74, an arm bar 80, a first part 81, a second part 82, a top end 83, a bottom end 84, a set screw 85, a grip area 86, a locking bracket 87, locking slots 88, a locking pin 89, scores 90, mount sockets 91, rail terminators 92, a locking plate 93, a mount surface 94, a pivot 95 and a flat face 96.

The present invention can fulfill the spirit of the invention with just one rail 10. However, it is preferable to have two or more rails 10. The rail 10 may preferably be manufactured out of stainless steel, as well as, but not limited to, iron, aluminum, a metal alloy, a reinforced polymer, a polyvinyl composite, or wood. The rail 10 may preferably be a hollow tube, but may also be a solid tube or a square and hollow or solid bar. The rail 10 may have a chrome-plated surface for shiny, clean and polished appearance. However this is not functionally or structurally required. The length of the rail 10 between the back bracket 14 and the front bracket 12 may be between 4 and 7 feet.

The rail 10 preferably has a curved sideways ellipse, thus forming a pair of parallel rails 10. The rails 10 may be parallel and linked with the front bracket 12 or the back bracket 14 or with the buffers 16, and not have a rounded elliptical linkage as shown at distal ends 10A and 10B. The front slope 17 and the back slope 18 are bent toward the stand 20, with the peak 19 being in the middle. This combination of slopes 17 and 18 and a peak 19 form a curved rail 10, which is the preferred embodiment for the rail 10. A convex rail is shown, having a peak 19. Alternatively the rail 10 may be reversed with slopes 17 and 18 serving as peaks and with the peak 19 forming a trough. Since the rail 10 forms an arc above the stand 20 it is preferable that the central angle of this arc may be 2 and 5 degrees. Each of the two invisible vectors creating the segment of the arc represented by the rail 10 is equal to the length of the radius of the arc. The preferable range of the radius of the full circle, whose arc is represented by the curvature of the rail 10, may be between 10 and 15 feet. Alternatively, the rail 10 may be substantially straight, and may contain mounting hooks or other means, to mount an assortment of resistance elements, such as bands and springs.

The rail 10 may be attached to the stand 10, which may be the preferred means for supporting the rail 10, with the front bracket 12 and with the back bracket 14. The buffers 16 may be integral with the front and back bracket 12 and 14, or may be separate. The means of attaching the rail 10 to the brackets 12 and 14 and for attaching the brackets 12 and 14 to the means for supporting the rail 10 may be with fasteners, clamps, welding or crimping. The brackets 12 and 14 or the buffer 16, or the distal ends 10A and 10B may function as a final travel point of the seat 60. The front bracket 12 preferably forms an acute forward facing angle, with one vector of the angle resting on the stand 10 and the other vector reaching up to secure the rail 10 using a means described above. The back bracket 14 may be the same or similar acute angle as the front bracket 12, and faces toward the back end 24 of the stand 20. Alternatively, the brackets 12 and 14 may be monolithic with the stand 20, and may form posts jutting out of the longitudinal brace 21, towards the rail 10.

Still referring to FIG. 1, the slider 66 of the seat 60 may slide or ride longitudinally along the rail 10, and enables the slidable connectivity between the seat 60 and the rail 10. The slider 66 may contain internal ball bearings or wheels that are in direct contact with the surface of the rail 10. The slider 66 need not contain bearings, but may be a lubricated sleeve surrounding the rail 10 or a sleeve made of a material with low frictional coefficient, and not contain any wheels or ball bearings. In another alternative, the slider 66 may be integral to the seat 60. The slider 66 preferably also contains a swiveling mechanism for the seat 60 and may additionally contain a pin or peg or a lever that would prevent swiveling by the seat 60 or that would enable it. The swiveling mechanism is not shown, but is generally well known in the art and is essentially an axle with at least one washer or flange that face each other, but other embodiments are possible as well.

One using the apparatus 5, which is the article of manufacture embodied in the present invention, would push off with legs, while sitting on the seat 60. The seat 60 may start out at the peak 19 or either the front slope 17 or the back slope 18. The force of gravity coupled with the frictional resistance between the seat 60 and the rail 10, provides the resistive force that causes the desired strain of the targeted muscle groups, as the seat is pushed backward, up the front slope 17, or forwards and up the back slope 18. The peak 19 forms little gravitational resistance. However, the inertia of the initial push-off propels the seat 60 downward the opposite slope 17 or 18 and thereby persists with the exercise by placing counteractive stress on the targeted muscle groups. This maneuver is repeated multiple times as desired by the training routine.

The resistance of the rail 10 may be increased by having the capability to adjust the height of the front slope 17 or the back slope 18. High adjustment may be accomplished by mounting and adjustment screw, a pin or a clam on either the front bracket 12 or the back bracket 14, or the bracket 32 on either the front or back rail 30 of 40. Such a screw, clamp or pin would then be mounted within an opening in the longitudinal brace 21. Lengthening or shortening the length of such a screw or clamp would increase or decrease the pitch of either the front slope 17 or the back slope 18. Alternatively, a rod or a notched brace may be used, with either the brackets 12 and 14, or the longitudinal brace 21, or the bracket 30 having set a set screw that would determine the elongation distance of such a rod or a notched brace, which would in turn determine the level of elevation of either slope 17 or 18 and of the degree of resistance resulting from the elevation pitch.

The rail or rails 10, upon which the seat 60 slides on, are pictured as tubular but could be a variety of shapes and forms. The rails 10 are curved in an arc, and are held in an upright position, i.e., with the middle of the rail 10 at a higher elevation than both ends, which is also referred herein as the peak 19. The rails 10 could be fixed at each end or swivel. The back end rail 40 could also made to slide from side to side. The rails 10 or the front and back rails 30 and 40, could have a combination of fixed end points, swivel end points or sliding end points.

The seat 60 may be swiveling and it preferably contains handles 70 that are square or elliptical in appearance. The seat 60 can rotate laterally, which expands the range of motion and muscles used for the abdominal exercise. Handles 70 attach to the seat provide another degree of exercise movement. The handles 70 are preferably mounted to the side of the seat 60 at the mount area 74. The handles 70 may contain a specially coated grip area 72, which may be a soft and/or frictional surface or a sleeve made of rubber, resin or a frictional and/or soft polymer. The swivel action may be desired to train the oblique muscle group, located on the sides of a person's trunk. The seat 60 may be cushioned or hard and may be upholstered with leather or plastic may use any other filling, cushioning or upholstery. For a better grip on a user's buttocks the seat 60 may contain a recessed middle 62 and a slightly elevated edge 64. Either of these areas may contain frictional or jagged elements, or may be substantially flat and smooth.

Still referring to FIG. 1, the stand 20 provides the preferred means of support for the rail 10. The stand 20 may be made of a longitudinal brace 21, which may provide the main mounting point for the rail 10, the front end rail 30, and the back end rail 40. The front and back end rails 30 and 40 function to provide lateral stability of the apparatus 5. The front end rail 30 and the back end rail 40 as well as the front end 22 and the back end 24 may be terminated by rail terminators 92, which function to conceal sharp edges of the structural components of the stand 20. Alternatively, the means for supporting the rail 10 may be a circular or a square brace (not shown or legs that may support the rail 10 above the floor. Any other embodiment for the supporting means may be used.

The longitudinal brace 21 is shown mounted on top of the front-end rail 30 and the back end rail 40. Both front end rail 30 and the back end rail 40 may additionally contain fasteners 31 and a bracket 32. The front end rail 30 or the back end rail 40 may swivel about the joint between the longitudinal brace 21 and the bracket 30. The swiveling feature may be accomplished by disposing a rod or an axle within opposite facing openings of the longitudinal brace 21 and either or both of the front end or the back end rails 30 or 40, or between the longitudinal brace 21 and the bracket 30 that may be fastened to either or both the front end and back end rails 30 and 40. The longitudinal brace and the front and back end rails 30 and 40 may then be kept apart by two ends of a swivel axle that may be abutting hard surfaces within the openings or by ball bearings separating the longitudinal brace 21 and the two rails 30 and 40. The bracket 32 is not strictly necessary, but may facilitate the swiveling functionality. Additionally the bracket 32 may be used to enable the pitch adjustment of the front slope 17 or the back slope 18 of the rail 10.

The front end brace 30 additionally contains at least one arm bar 80. Arm bars 80, also referred to herein as arm posts, are incorporated for assisting the exercise movement. Preferably there should be two arm bars 80 that are disposed along the front-end brace 30, within the fixating brackets 87, and substantially towards the terminuses 92. The arm bar 80 may be used as a stationary support to train the muscles of the arms and the upper body. The arm bars 80 may be fixed, adjustable or free moving. These arm bars 80 may or may not have resistance for upper body exercise. They may be dependent or independent of each or the unit. The arm bar 80 may be able to rock back and forth against a resistive force, which may be a band or a spring. In such an embodiment a user may additionally or primarily train his or her upper body and arms by rocking the arm bars 80 backwards and forwards, while the remaining stationary in the seat 60, or while executing abdominal exercises using the seat 60. Under these circumstances, a user may swing each arm bar 80 in the same or in alternating directions, and each arm bar may swing independently or in coordination with the other arm bar 80 or with the motion of the seat 60.

The arm bar 80 is preferably adjustable, having a first part 81 and a second part 82. The first part 81 and the second part 82 are capable of sliding within each other to vary the length of the arm bar 80, with a desired length being secured with a set screw 85, which may also be a spring loaded pin, a regular pin or any other fixating means common in holding two telescoping segments at a desired length. The first part 81 may additionally contain indentations or scores 90 that may further secure the set screw 85. The second part 82 may contain a grip area 86, having frictional elements or coatings to enhance one's grip during an exercise routine.

The first part 81 may be mounted within a mount socket 91 at the bottom end 84, which is then mounted between semicircular locking plates 93 of the fixating bracket 87. Alternatively, the bottom end 84 may be mounted directly within the locking plates 93, without a mount socket 91. Also possible is just one locking plate 93 for each arm bar 80. In an alternative embodiment, the first part 81 and the second part 82 may be merged into a single part, and the arm bars 80 may be strait, circular, or twisted into any other shape.

The locking bracket 87 may preferably be made up of a base surface 94 and two semicircular locking plates 93. The base surface 94 may be mounted unto the front-end rail 30 with either welding, fastening, gluing or using any other means of permanent attachment. The preferred orientation of the base surface 94 and the locking plates 93 is perpendicular to the axis of the front-end rail 30. There may be just one locking plate 93 for each base surface 94. The locking pin 89 is preferably a spring-loaded pin that is capable of fitting within locking slots 88 of the locking plates 93. The locking pin 89 may be used to adjust the upright angle of the arm bar 80 by depressing the locking pin 89 until it clears the locking slot 88. The arm bar 80 is then rotated about the pivot 95 until a desired locking slot 88 is reached. The top end 83 may be preferably slanted, with the flat face 96 facing away from the seat 60. The flat face 96 may be used to a user with hand support when he or she wishes to resume an erect position after using the apparatus 5.

The back end rail 40 provides supplemental lateral support to the apparatus 5. The elongated brace 21 is attached to the back end rail 40 with fasteners, adhesive, and welding or any other means of attachment. This attachment may be direct or contain a bracket 30, which may additionally support a swivel functionality, as described herein. Preferably the back end rail 40 contains a sliding section or element 42, which is capable from emerging or submerging within the back end rail 40. The sliding elements 42 may have a terminus 92 and a stopper not shown, that would prevent the sliding element 42 from being completely removed the back end rail 40, which may cause it to get lost. The sliding element 42 may be utilized to create additional lateral support for aggressive exercising or when the apparatus 5 is being used by an especially heavy person.

The front end 22 preferably contains a front section 50. A front section 50 is preferably made up of an extension bar 51, which is inserted into the front end 22 of the longitudinal brace 21. The extension bar 51 is capable is sliding into or out of the longitudinal brace 21, thus providing adjustability of length for the means for support of the rail 10, which may be the preferred embodiment of a stand 20. The desired length of extension or submersion of the extension bar 51 may be secured with set screw 29, which may be a threaded fastener that would go through an opening along the longitudinal brace 21, then up against the side of an extension bar 51, thus immobilizing it. Other embodiments of a setscrew 29 may be a spring-loaded pin, or a simple insert pin. In case of a pin the extension bar 51 may contain scores that would meet and admit such a pin. The setscrew 29 may be similar to or the same as the set screw 85. Perpendicularly attached to the extension bar 51 is the perpendicular bar 52, thus forming a "T". In an alternative embodiment the stand 20 may not be extendable, therefore there perpendicular bar 51 or the foot holder 53 may be mounted directly unto the front end 22 of the supporting means for the rail 10.

The perpendicular bar 52 would preferably contain at least one-foot holder 53, which may be essentially a stirrup. The foot-holders 53 assist in anchoring the feet so an exercise can be performed. Each foot holder 53 preferably contains a strap 54 for securing a human foot to a foot platform 56. The strap 54 may be adjustable through the use of overlapping straps 54 having cooperating sides of a Velcro fastener or a belt buckle fastener. Each platform 56 may be attached at the mount area 55, which may be in the middle or the bottom of the foot platform 56. The foot holders 53 may be able to rotate about the perpendicular bar 52. Such rotation may or may not be preventable though the use of set screws or pins. Furthermore the foot platform 56 may contain a bumpy or jagged surface 56A which may serve to massage the soles of bare or socked feet of a user of the present invention or to create friction against soles of feet or shoes, so as to better enable the retention of a user's feet by the foot platforms 56, while the invention is being used for exercise. Alternatively, the front section 50 may be omitted, with a user placing feet directly on the ground or floor that is supporting the supporting means for the rail 10.

Alternatively, the perpendicular bar 52 may function as a foot holder. In this embodiment a user may wrap the anterior or top portion of his or her foot around the perpendicular bar 52 and proceed with an exercise routine. Alternatively the foot holder 53 may be two or more perpendicular bars 52, disposed as a later at the end of an extension bar 51. A user may use this by placing the posterior side legs on a top perpendicular bar 52 and placing the anterior portion of a foot on the bottom perpendicular bar, or by placing ones foot in between two perpendicular bars 52. In yet another alternative the foot holder may be a soft or hard loop for snagging a user's foot or any other means that is capable of immobilizing a user's foot during abdominal, leg and upper body exercises.

Figure 2:
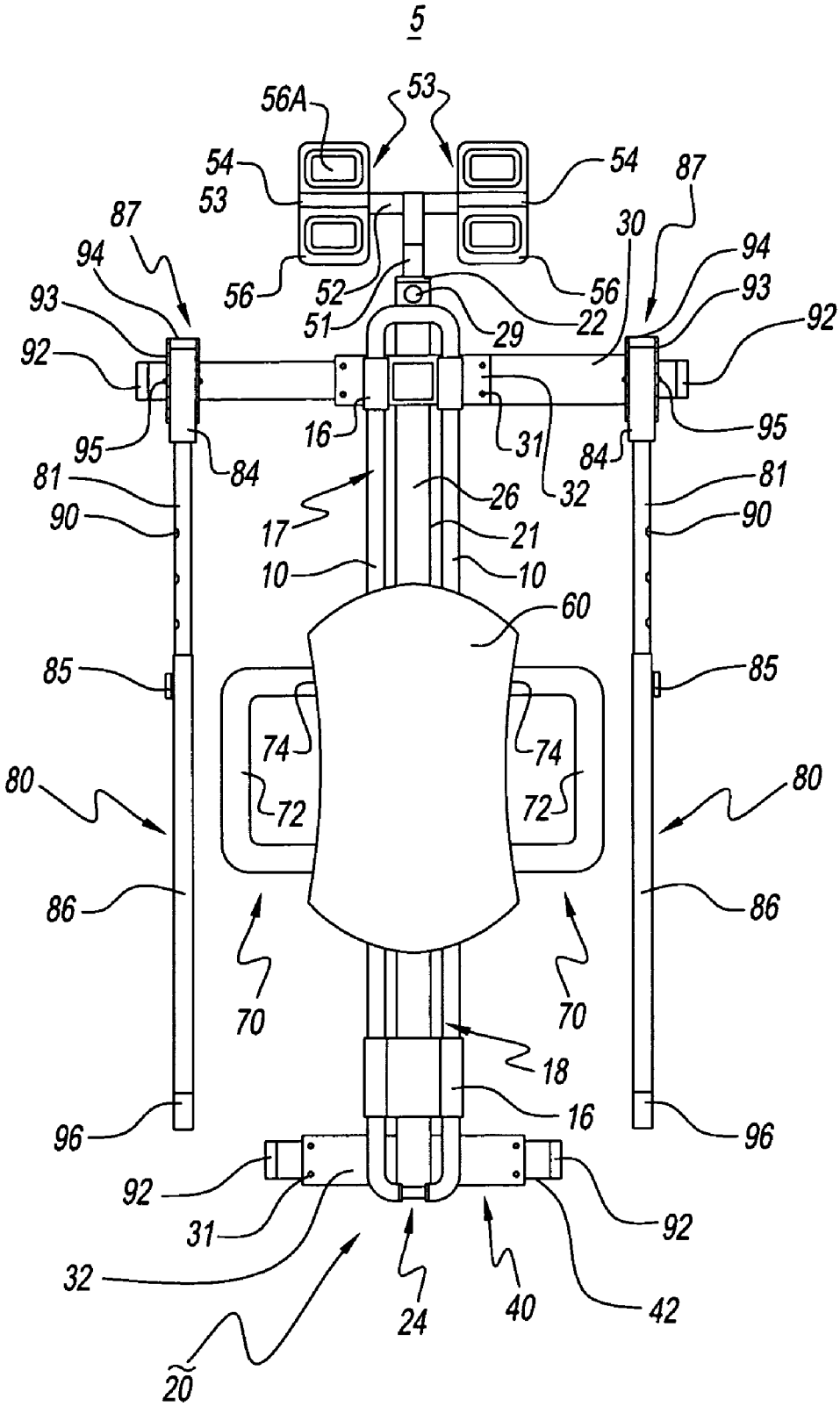
FIG. 2 is a top view of the preferred embodiment.

FIG. 2 is a top view of the present invention. Shown are an apparatus 5, a rail 10, a front bracket 12, a back bracket 14, a buffer 16, a front slope 17, a back slope 18, a peak 19, a stand 20, a longitudinal brace 21, a front end 22, a back end 24, a stand top 26, a set screw 29, a front end rail 30, fasteners 31, a bracket 32, a back end rail 40, sliding element 42, a front section 50, an extension bar 51, a perpendicular bar 52, a foot holder 53, a strap 54, a mount area 55, a foot platform 56, a bumpy surface 56A, a seat 60, a handle 70, a grip area 72, a mount area 74, an arm bar 80, a first part 81, a second part 82, a top end 83, a bottom end 84, a set screw 85, a grip area 86, a locking bracket 87, scores 90, mount sockets 91, rail terminators 92, a locking plate 93, a mount surface 94, a pivot 95, and a flat face 96. The length of the longitudinal brace 21 of the stand 20 may preferably be between 5 and 7 feet when fully extended and between 3.5 and 4.5 feet and fully collapsed. The width of the front-end rail 30 may be between 1.5 and 3 feet. The width of the back end rail 40 may be between 0.5 and 1.5 feet when not extended and between 0.5 and 3 feet when extended. Note that both the front-end rail 30 and the back end rail 40 may contain sliding elements 42 and that both the frond end rail and the back end rail may have a width or position of the rail 10 that is slidably adjustable. Slidably means that the sliding elements 42 may slide in or out of the front end rail 30 or the back end rail 40, until a desired width of the rail 30 or 40 or the position along the sliding element 42 has been established. The slidability need not be locked but may be utilized as another form of lateral exercise motion, where a user may rock the seat 60 from side to side and achieve a sliding of the apparatus 5 along the sliding element 42. The spread between the twin rails 10 may be between 1 to 5 inches.

Figure 3:
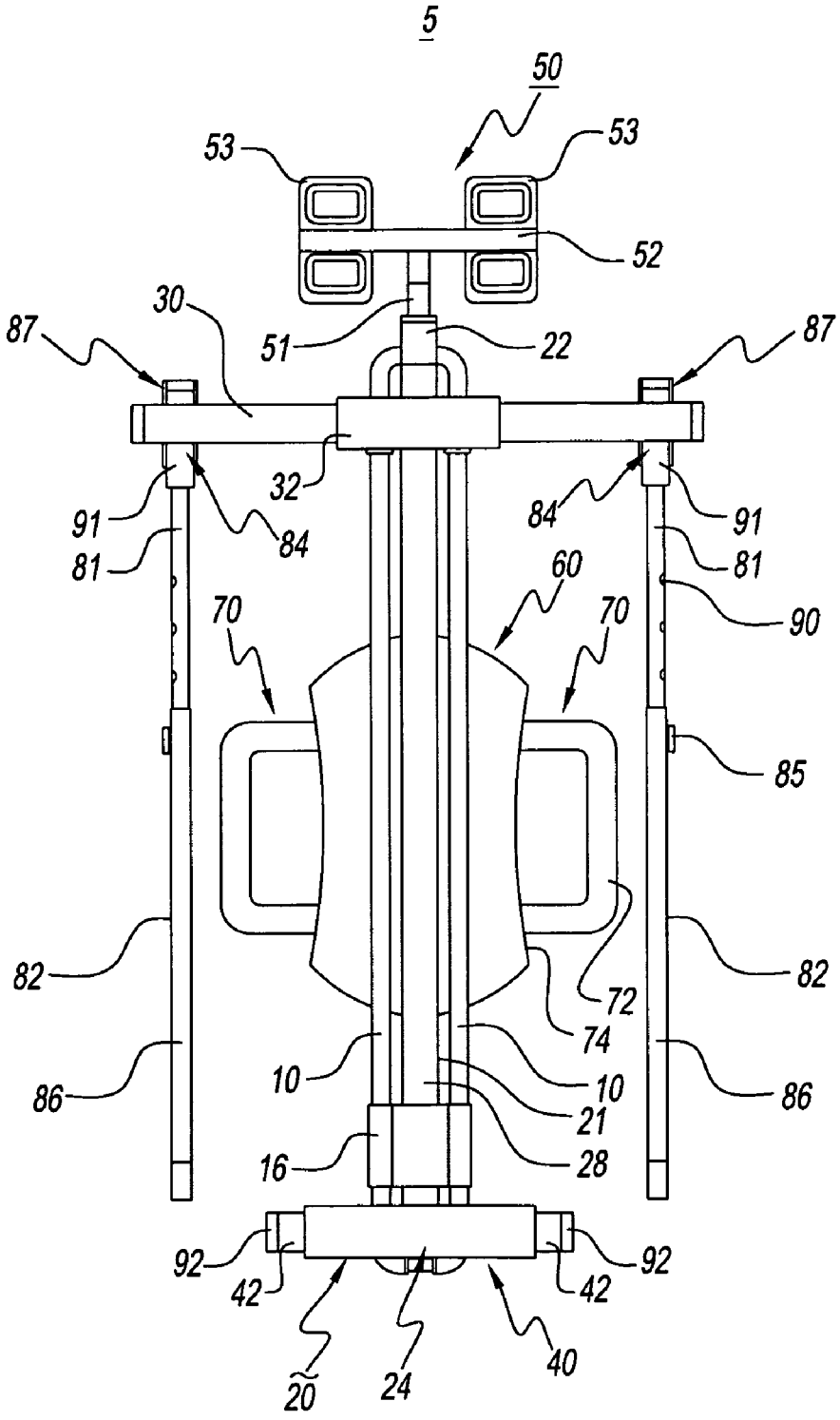
FIG. 3 is a bottom view of the preferred embodiment.

FIG. 3 is a bottom view of the present invention. Shown are an apparatus 5, a rail 10, a front bracket 12, a back bracket 14, a buffer 16, a stand 20, a longitudinal brace 21, a front end 22, a back end 24, a stand bottom 28, a front end rail 30, a bracket 32, a back end rail 40, a sliding element 42, a front section 50, an extension bar 51, a perpendicular bar 52, a foot holder 53, a seat 60, a handle 70, a grip area 72, a mount area 74, an arm bar 80, a first part 81, a second part 82, a top end 83, a bottom end 84, a set screw 85, a grip area 86, a locking bracket 87, scores 90, mount sockets 91, and rail terminators 92.

Figure 4:
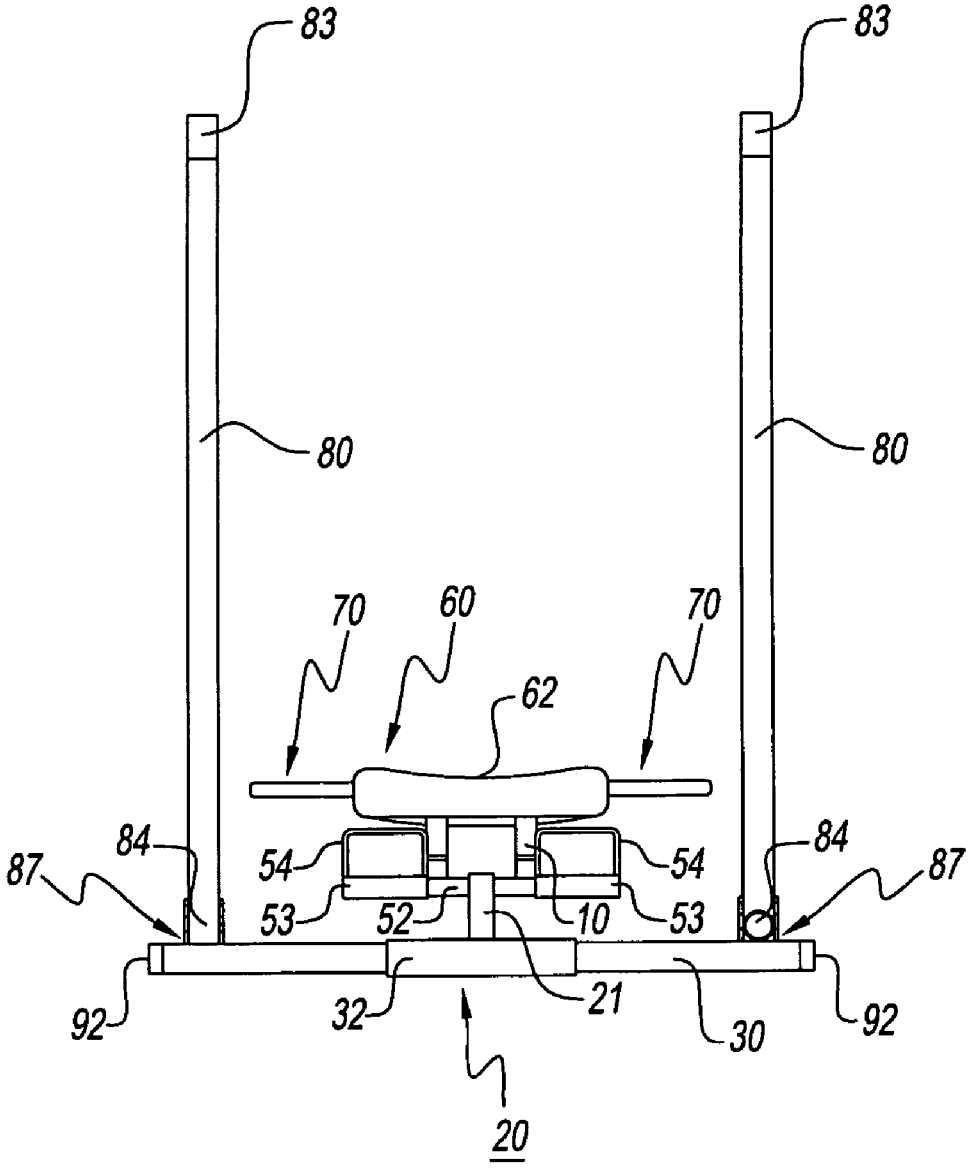
FIG. 4 is a bottom view of the preferred embodiment.

FIG. 4 is a front view of the present invention. Demonstrated in figure are an apparatus 5, a curved rail 10, a stand 20, a longitudinal brace 21, a front end rail 30, a bracket 32, a perpendicular bar 52, a foot holder 53, a strap 54, a seat 60, a middle of the seat 62, edges of the seat 64, a handle 70, an arm bar 80, a top end 83, a bottom end 84, a locking bracket 87, and rail terminators 92. The longitudinal brace 21, the front and back end rails 30 and 40, and the arm bars 80 may be square or elliptical and either hollow or solid. These elements should preferably be made of steel, iron, aluminum, wood or a metal alloy. They can also be manufactured from a polymer, preferably a reinforced polymer or a reinforced resin, rubber, or a polyvinyl compound. Besides terminators 92 other protective anti-scratch elements may be provided, such as elements that prevent the stand 20 from scratching the floor.

Figure 5:
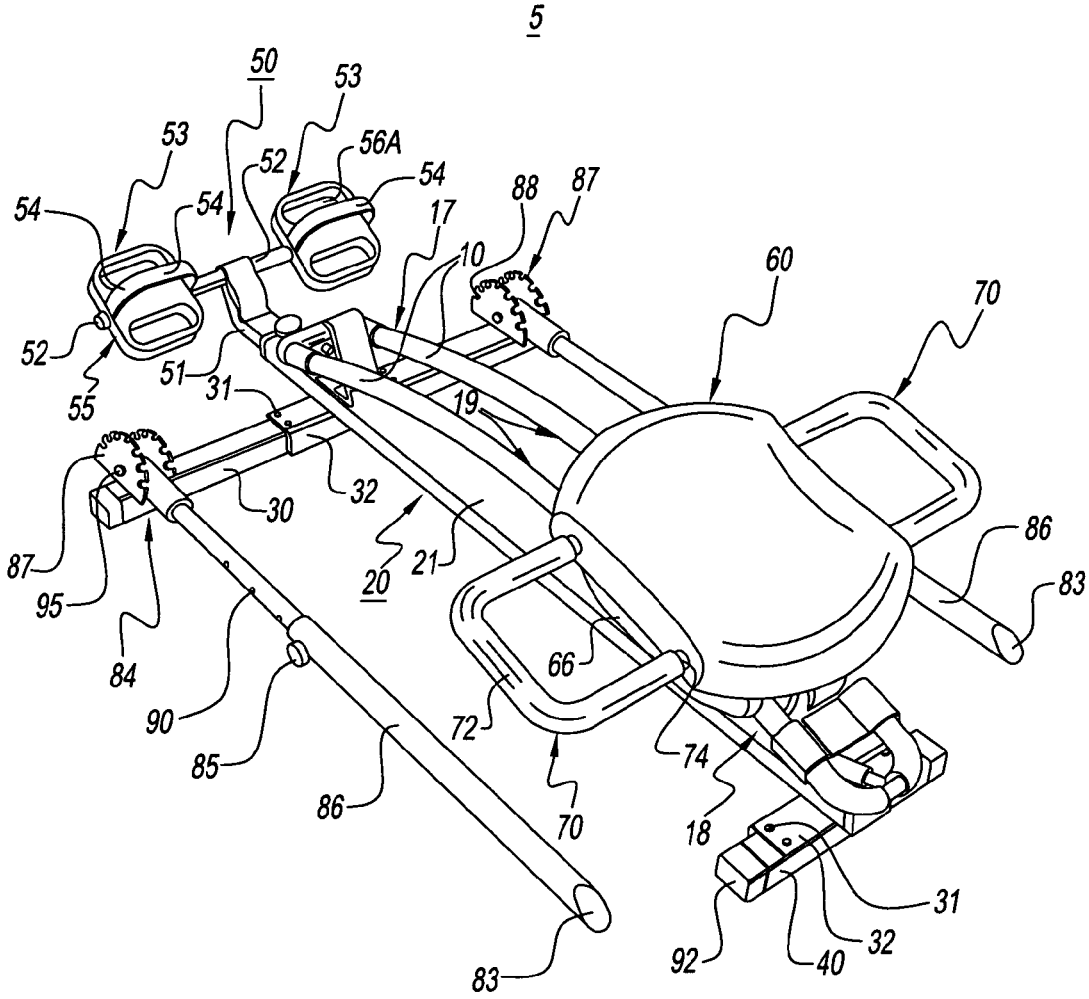
FIG. 5 is a folded view of the present invention.

FIG. 5 is a prospective top view of the present invention in its fully folded state. Shown are an apparatus 5, a curved rail 10, a front bracket 12, a back bracket 14, a buffer 16, a front slope 17, a back slope 18, a peak 19, a stand 20, a longitudinal brace 21, a front end 22, a back end 24, a stand top 26, a stand bottom 28, a set screw 29, a front end rail 30, fasteners 31, a bracket 32, a back end rail 40, sliding element 42, a front section 50, an extension bar 51, a perpendicular bar 52, a foot holder 53, a strap 54, a mount area 55, a foot platform 56, a bumpy surface 56A, a seat 60, a slider 66, a handle 70, a grip area 72, a mount area 74, an arm bar 80, a first part 81, a second part 82, a top end 83, a bottom end 84, a set screw 85, a grip area 86, a locking bracket 87, locking slots 88, scores 90, rail terminators 92, a locking plate 93, a mount surface 94, and a pivot 95. The present invention may be just up to 0.5 feet tall when fully folded and between 3 and 4.5 feed when fully expanded. When collapsing or folding the apparatus 5, the seat 60 may slide toward one of the slopes 17 or 18 to lower the overall profile the unit. A separate locking pin (not shown) may be provided within the seat 60 or the runner 66 to immobilize the seat 60 for storage. This way, if the apparatus is placed on one of the ends 22 or 24, the seat 60 will not come rushing downwards, possibly causing injury or damage.

Figure 6A:
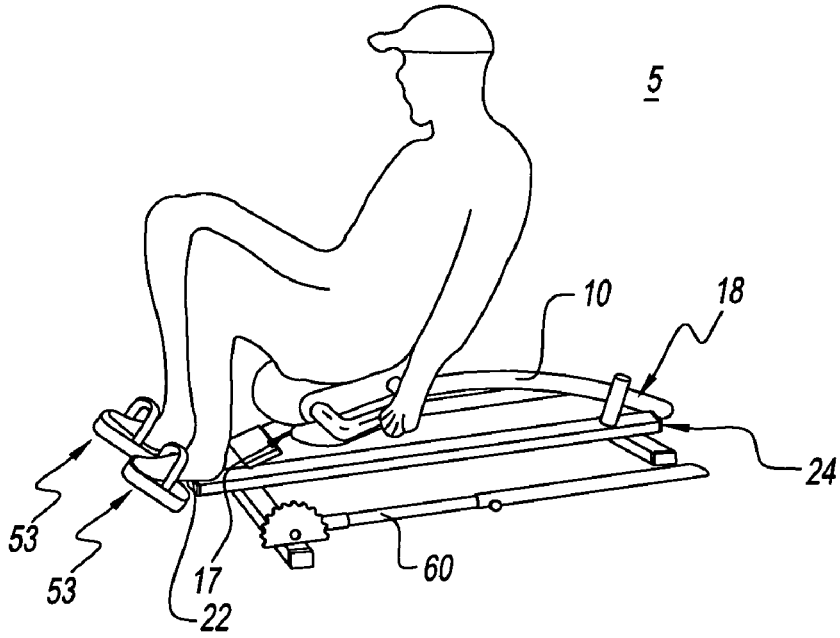
FIGS. 6A-6D illustrate different exercise routines that may be carried out by using the preferred embodiment of the present invention.

The present invention may be used to run an assortment of exercises that are mentioned herein and others not mentioned. FIG. 6A demonstrates one exercise routine that starts with a user assuming an open position toward the front end 22 or front slope 17 of the rail 10, and while sliding towards the back end 24 or the back slope 18, bending into a crunched position. This movement may be repeated in rhythm.

Figure 6B:
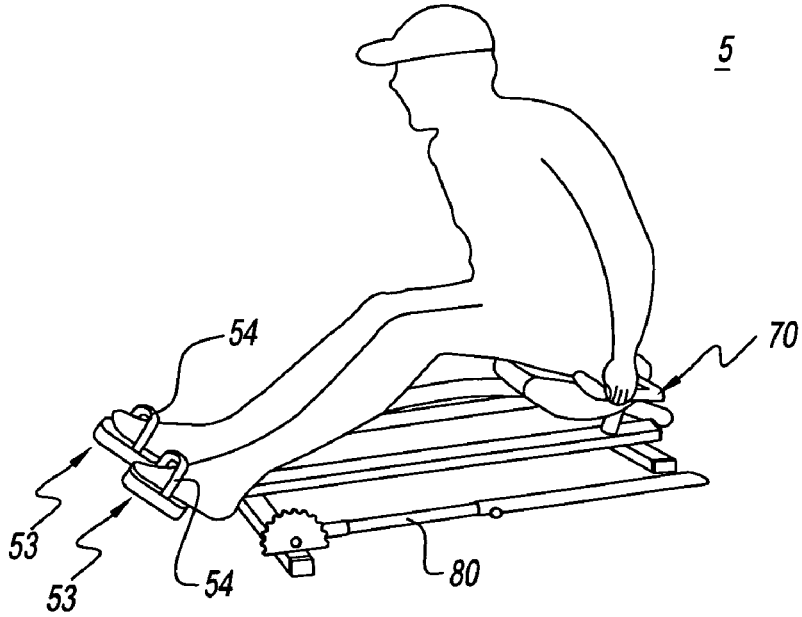

FIG. 6B shows another exercise where a user sits on seat 60 which may be capable of swiveling. A user positions his or her feet within foot holders 53 and secure a strap 54. A user then slides the seat 60 to front end of the rail 10, then leans slightly backwards in an extension position. The seat handles or handles 70 or arm bars 80, also known as arm posts, may be used to assist and to prevent falling while moving forward or backwards upon the seat 60. A user then slides backward along the rails 10 while bending forward in a crunched position, then reverses the sliding movement forward while returning to starting position. The user may repeat the movement over and over, as desired. The movement is an open and close, similar to a general sit-up but with the added movement of sliding forward and backwards on an arc. This movement will have a low impact, full range of motion of Abs, Legs, and Back as well as incorporating the arms throughout the movement. For added resistance the front end 22 or the front slope 17 may be raised or elevated for advanced users.

Figure 6C:
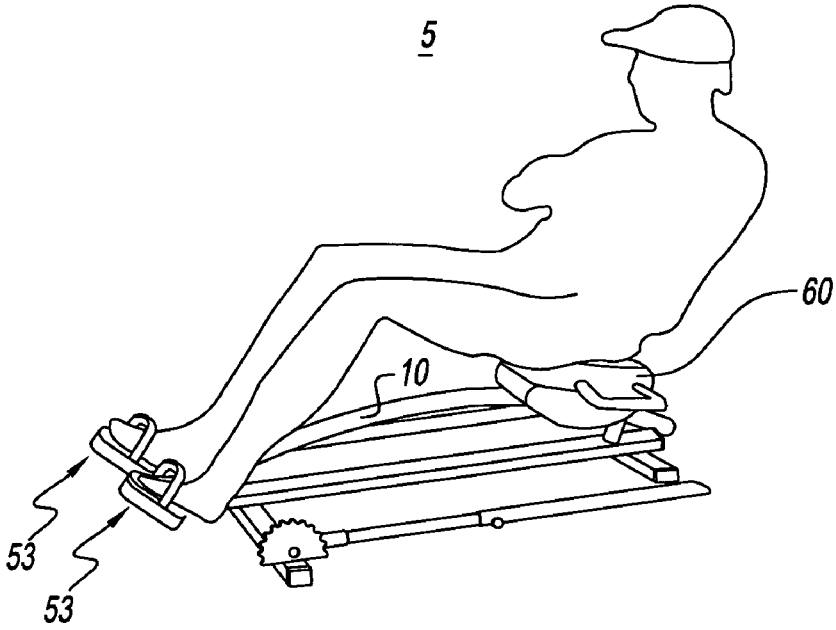

FIG. 6C shows that releasing the seat 60 from the fixed position to a swivel position can vary exercises. This permits working the side abdominal or oblique muscles, as well as the arms and upper body. The unit may incorporate a sliding back end or sliding elements 42 instead of being a fixed back end rail 40. The back end sliding elements 42 or the entire back end rail 40 may slide along a rail 10, which will permit left and right sliding movement in addition to the straightforward and back movement. One can also use the present invention for leg exercises. For example, single or double leg squats as well as working the calf muscles (pointing and extending toes or feet) with one's legs fully extended and locked in position.

Figure 6D:
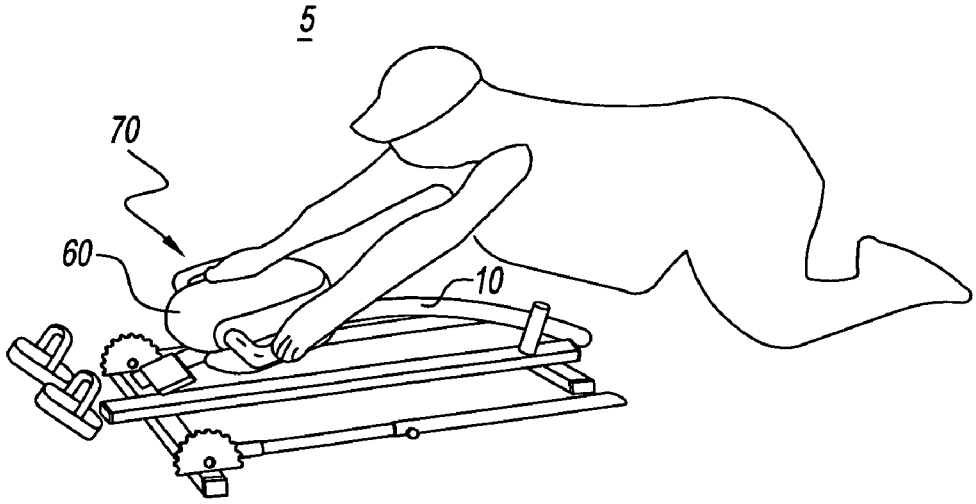

FIG. 6D demonstrates that the apparatus 5 may also be used for kneeling exercise by kneeling behind the unit and grabbing the seat handles 70. One then slides forward while keeping knees fixed in place. The seat 60 is pushed forward along the rails 10 towards the front of the unit 22 and then returned back to starting position. The position of the knees may be adjusted to maximize the sliding extension effect.

Although this invention has been described with a certain degree of particularity, it is to be Understood that the present disclosure has been made only by way of illustration and that numerous changes in the details of construction and arrangement of parts may be resorted to without departing from the spirit and the scope of the invention.

What is claimed:

1. An article of manufacture, comprising:

at least one curved rail having a stand for supporting the curved rail in an upright position, said stand being adjustable in length and further comprising a front end rail and a back end rail, and wherein said supported curved rail swivels with respect to said front end rail and wherein said supported curved rail is slidably adjustable along said back end rail; and a seat slidably connected to the at least one curved rail.

2. The article of claim 1, wherein the article has two curved rails.

3. The article of claim 1 wherein the stand has at least one foot holder.

4. The article of claim 1, wherein the seat swivels.

5. The article of claim 1, wherein the article further comprises at least one arm bar.

6. The article of claim 1, wherein the arm bar is adjustable.

7. The article of claim 5, wherein said arm bar further comprises a resistance rocker.

8. The article of claim 5, wherein a height of said arm bar is adjustable.

9. The article of claim 1, wherein said seat further comprises at least one handle.

* * * * *